US005851059A

United States Patent [19]

Cirocco

[11] Patent Number: 5,851,059

[45] Date of Patent: Dec. 22, 1998

[54] TWO-WAY EXTENDED TRAVEL SLIDE SUSPENSION

[75] Inventor: Paul Cirocco, Yorba Linda, Calif.

[73] Assignee: Jonathan Manufacturing Corporation, Fullerton, Calif.

[21] Appl. No.: 812,938

[22] Filed: Mar. 4, 1997

[51] Int. Cl.[6] ..... A47B 88/00

[52] U.S. Cl. ..... 312/334.11; 321/334.8; 321/333; 321/330.1; 384/18

[58] Field of Search ..... 312/334.11, 330.1, 312/334.1, 334.7, 334.8, 334.17, 334.22, 334.44, 334.46, 334.47, 333; 384/18, 19, 20, 21, 22; 296/26, 37.6

[56] References Cited

U.S. PATENT DOCUMENTS

| | | | |
|---|---|---|---|
| D. 291,636 | 9/1987 | Rechbert . | |
| D. 385,474 | 10/1997 | Rechberg . | |
| 2,528,910 | 11/1950 | Poe . | |
| 3,650,578 | 3/1972 | Del Vecchio et al. . | |
| 4,089,568 | 5/1978 | Fall . | |
| 4,183,596 | 1/1980 | Greene et al. | 312/333 |
| 4,370,007 | 1/1983 | Fler . | |
| 4,423,914 | 1/1984 | Vander Ley | 312/333 |
| 4,469,384 | 9/1984 | Fler et al. | 312/334.11 X |
| 4,537,450 | 8/1985 | Baxter . | |
| 4,560,212 | 12/1985 | Papp et al. | 312/334.47 |
| 4,573,731 | 3/1986 | Knaack et al. | 312/334.8 X |
| 4,747,242 | 5/1988 | Aarstad . | |
| 4,749,242 | 6/1988 | Rechberg . | |
| 4,872,734 | 10/1989 | Rechberg . | |
| 5,085,523 | 2/1992 | Hobbs | 384/18 X |
| 5,169,238 | 12/1992 | Schenk | 312/333 X |
| 5,181,782 | 1/1993 | Wojcik | 384/21 |
| 5,316,389 | 5/1994 | Hoffman | 384/18 |
| 5,388,902 | 2/1995 | Huebschen et al. . | |
| 5,411,333 | 5/1995 | Hoffman . | |
| 5,417,496 | 5/1995 | Hobbs | 384/18 |
| 5,466,060 | 11/1995 | Hoffman | 312/334.8 |
| 5,470,143 | 11/1995 | Gill | 312/334.4 |
| 5,484,209 | 1/1996 | Weng | 384/18 |
| 5,507,571 | 4/1996 | Hoffman . | |
| 5,551,775 | 9/1996 | Parvin | 312/334.11 |
| 5,564,767 | 10/1996 | Strepek | 312/334.47 X |
| 5,570,915 | 11/1996 | Asadurian . | |
| 5,577,821 | 11/1996 | Chu | 312/334.8 X |
| 5,588,686 | 12/1996 | Riley et al. . | |

FOREIGN PATENT DOCUMENTS

| | | |
|---|---|---|
| 585037 | 8/1993 | European Pat. Off. . |

*Primary Examiner*—Jose V. Chen
*Assistant Examiner*—James O. Hansen
*Attorney, Agent, or Firm*—Knobbe, Martens, Olson & Bear, LLP

[57] ABSTRACT

A slide suspension including an inner channel, a middle channel, and an outer channel, with the outer channel being fixed to a surrounding frame, the inner channel being fixed to a drawer or similar expedient, and the middle channel suspended on bearings therebetween. The double-action extension is sequenced so that the inner and middle channels extend together first until the middle channel reaches its full length of travel, at which point the inner channel may extend further. Likewise, the inner channel retracts first into the middle channel, and then the middle channel retracts into the outer channel. An interlock is provided between the inner and middle channels and alternately locks and frees the inner channel with respect to the middle channel. The interlock is preferably a single durable plastic member which is fixed with respect to the middle channel and includes an actuating block spring-biased into a second position in which the inner channel is free to move with respect to the middle channel.

38 Claims, 8 Drawing Sheets

TWO-WAY EXTENDED TRAVEL SLIDE SUSPENSION

FIELD OF THE INVENTION

The present invention relates to a slide assembly and, more particularly, to a heavy-duty two-way, double-action slide suspension for drawers or other retractable shelves.

BACKGROUND OF THE INVENTION

Drawers are commonly used in package delivery vehicles, where the drawer is extremely large and the contents are very heavy. Because of this, the drawer and slide suspension must be made relatively rugged to withstand heavy loads, and great impact upon sudden extension of the drawer. Additionally, in such environments, space is at a premium and it is important that the overall width of the slide be kept to a minimum thereby permitting the use of the widest possible drawer.

Drawer slides are typically mounted on opposing sides of a drawer, and support the drawer while permitting it to be slid open and closed. There are two common types of drawer slides. The first type includes two members, one fixed to the surrounding frame, and one fixed to the drawer, which slide with respect to one another. When used in a high drawer load environment, these two-member slides only permit the drawer to be extended up to approximately to one-half of its length from inside the frame. In a three-member or double-action slide suspension, an outer channel is affixed to the frame, a middle channel slides with respect to the outer channel, and an inner channel slides with respect to the middle and outer channels and is fixed to the drawer. Because the middle channel is detached from both the surrounding frame and drawer, it is "suspended" between the inner and outer channels. In the double-action type of slide suspensions, even in high drawer load environments, the drawer can be pulled out or extended from within the frame nearly its entire length.

To avoid damage to the weaker inner channel, it is desirable that first the middle channel slide with respect to the outer channel, and then the smaller inner channel completes the full extension of the slide. Such a drawer slide suspension is shown in U.S. Pat. No. 5,551,775 to Parvin, in a one-way drawer system. This design, however, relies on a rather complicated mechanism and a complex-shaped latch acted on by external surfaces which either pivots or translates to enable the sequenced extension.

Most drawers can be extended on one side of the surrounding frame, such as with desk drawers. Some drawers, however, are capable of two-way extension, and can be extended on either side of the frame. Such a two-way extendable drawer slide is shown in U.S. Pat. No. 4,183,596 to Greene, et al. In Green, a two-way, double-action drawer slide mounted within a service vehicle permits the drawer to be extended to either side of the vehicle. Undesirably, the Green design initially permits the inner channel to slide freely with respect to the middle channel. This initial movement of the inner channel initially places great weight on the weaker inner channel.

Although there have been many attempts to provide a rugged and reliable two-way drawer slide for delivery vehicles, most designs are either too complex, and thus expensive to manufacture, or do not provide adequate strength for the drawers.

Given the drawbacks of the prior art, a need exists for an improved slide assembly particularly in heavy duty environments.

SUMMARY OF THE INVENTION

The assembly of the present invention provides an improved slide arrangement particularly adapted to use a minimum of parts for inexpensive manufacture and assembly. Advantageously, the assembly is particularly adapted for use in a two-way double action drawer suspension wherein the inner segment is only slidable once the middle segment has been fully extended, thereby minimizing stress on the inner segment. Further, the assembly is preferably adapted to achieve these advantages within a relatively narrow working envelope.

One aspect of the invention is an assembly including an outer segment, a middle segment, an inner segment and an interlock. The outer segment is fixable to a surrounding frame. The middle segment is slidable with respect to the outer segment and the inner segment is slidable with respect to the middle segment. The interlock is positioned generally between the middle segment and the inner segment. The interlock includes at least a first portion movable toward and away from the inner segment. The first portion is movable between a first position in which the inner segment and the middle segment are locked to move together and a second position in which the inner segment is free to move with respect to the middle segment.

To facilitate ease of assembly, the interlock desirably comprises a single piece. Advantageously, the interlock can be resilient and the first portion of the interlock can be cantilevered with respect to the second portion of the interlock. The first portion of the interlock desirably includes a camming surface which cooperates with one of the outer segment and the inner segment to move the interlock between one of the first position and the second position and the second position and the first position. In its preferred embodiment, the inner segment defines a first edge which defines a first aperture within which the first portion of the interlock is located when the interlock is in the first position. Likewise, the middle segment may define a second edge which defines a second aperture within which the camming service of the first portion extends when the interlock is in the second position. In addition, the inner segment may define a third edge which defines a third aperture within which the second portion is located with the interlock is in its first position and its second position.

The assembly desirably includes a first ball retainer, a second ball retainer, a first set of bearings, a second set of bearings and a bridge. The first ball retainer defines a first series of stations for bearings and is positioned to a first side of the middle segment between the outer segment and the middle segment. The second ball retainer defines a second series of stations for bearings and is positioned to a second side of the middle segment between the outer segment and the middle segment. The first set of bearings is located within the first series of stations and the second set of bearings is located within the second set of stations. The bridge connects the first retainer, and the second retainer. Significantly, at least the first portion of the interlock and the bridge avoid contact with one another throughout the range of motion of the assembly so that the bridge will not interfere with the operation of the interlocking caused binding of the assembly.

Another important aspect of the invention is an assembly including an outer segment, a middle segment an inner segment and an interlock. The outer segment is fixable to a surrounding frame and has a first end and a second end. The middle segment is slidable with respect to the outer segment and the inner segment is slidable with respect to the middle segment. The inner segment and the middle segment are movable in a first direction beyond the first end of the outer segment and in a second direction beyond the second end of the outer segment. The interlock prevents relative movement between the inner segment and the middle segment when the middle segment is less than fully extended in the first direction beyond the first end of the outer segment. The interlock prevents relative movement between the inner segment and the middle segment when the middle segment is less than fully extended in the second direction beyond the second end of the outer segment. Importantly, this arrangement protects the inner segment from damage. Desirably, the interlock permits relative movement between the inner segment and the middle segment when the middle segment is fully extended in the first direction beyond the first end of the outer segment. Preferably, the assembly further includes a stop which prevents relative movement between the inner segment and the middle segment when the middle segment is fully extended in the second direction beyond the second end of the outer end. Advantageously, this arrangement includes a first ball retainer, a second ball retainer, a first series of bearings, second series of bearings, and a bridge connecting the first retainer and the second retainer, wherein a movable portion of the interlock and the bridge avoid contact with one another throughout the range of motion of the assembly.

Another aspect of the invention is a slide assembly including an elongated outer segment, a middle segment, an inner segment and an interlock. The elongated outer segment is fixable to a surrounding frame. The middle segment is slidable with respect to the outer segment and the inner segment is slidable with respect to the middle segment. The interlock advantageously comprises a single piece positioned generally between the middle segment and the inner segment and includes an actuating portion and a fixed portion. The actuating portion is movable between a first position in which the inner segment and the middle segment are locked to move together and a second position in which the inner segment is free to move with respect to the middle segment. Preferably, the inner segment and the middle segment define a first edge defining a first aperture wherein the fixed portion of the interlock is fixed to one of the inner segment and the middle segment through the positioning of the interlock generally between the inner segment and the middle segment and through the abutment of the interlock against the first edge. Significantly, the actuating portion may be moved between one of the first position and the second position and the second position and the first position through direct interaction of force between the interlock and one of the inner segment, the middle segment and the outer segment. Likewise, the actuating portion is desirably moved between the other of the first position and the second position and the second position and the first position through direct interaction of force between the interlock and one of the inner segment, the middle segment and the outer segment.

Desirably, the actuating portion is movable toward or away from the inner segment and the interlock defines a camming surface which cooperates with one of the outer segment and the inner segment to move the interlock between the first position and the second position. In a preferred embodiment, the actuating portion of the interlock is resiliently connected to the fixed portion and moves between the first position and the second position upon removal of external force applied to the biasing member by one of the inner segment, the middle segment and the outer segment. The assembly desirably includes a first ball retainer, second ball retainer, a first series of bearings, a second series of bearings, and a bridge connecting the first retainer and the second retainer, wherein at least the actuating portion of the interlock and the bridge avoid contact with one another throughout the range of motion of the assembly.

Yet another aspect of the invention is an assembly comprising a first slide assembly, a second slide assembly, and a slidable member such as a drawer, having a first side and a second side. The first slide assembly includes a first outer segment, a first middle segment, a first inner segment and a first interlock. The first outer segment is fixable to a surrounding frame. The first middle segment is slidable with respect to the outer segment and the first inner segment is slidable with respect to the middle segment. The first interlock is positioned between the first middle segment and the first inner segment and includes at least a first portion movable toward and away from the first inner segment. The first portion of the interlock is movable between a first position in which the first inner segment and the first middle segment are locked to move together, and a second position in which the first inner segment is free to move with respect to the first middle segment. The second slide assembly includes similar elements as the first slide assembly and the first inner segment is secured to the first side of the slidable member and the second inner segment is secured to the second side of the slidable member. Advantageously, the first and the second interlock further include a second portion fixed with respect to one of the inner segment and the middle segment.

Yet another aspect of the invention is a method of sequencing the opening of an assembly having a first outer segment, a middle segment slidable with respect to the first outer segment and an inner segment slidable with respect to the middle segment, including the steps of (1) positioning an interlock generally between the middle segment and the inner segment; (2) moving at least a first portion of the interlock one of toward and away from the inner segment to a first position to lock the inner segment with respect to the middle segment; and (3) moving at least the first portion of the interlock one of toward and away from the inner segment to a second position to permit relative movement between the inner segment and the middle segment. Desirably, the method includes fixing a second portion of the interlock with respect to one of the inner segment and the middle segment. Likewise, the method desirably includes moving the first portion of the interlock into a first aperture in the inner segment when the interlock is one of the first position and the second position, and moving the first portion of the interlock into a second aperture in the middle segment when the interlock is in one of the first position and the second position.

DETAILED DESCRIPTION OF THE PREFERRED EMBODIMENTS

Figure 1:
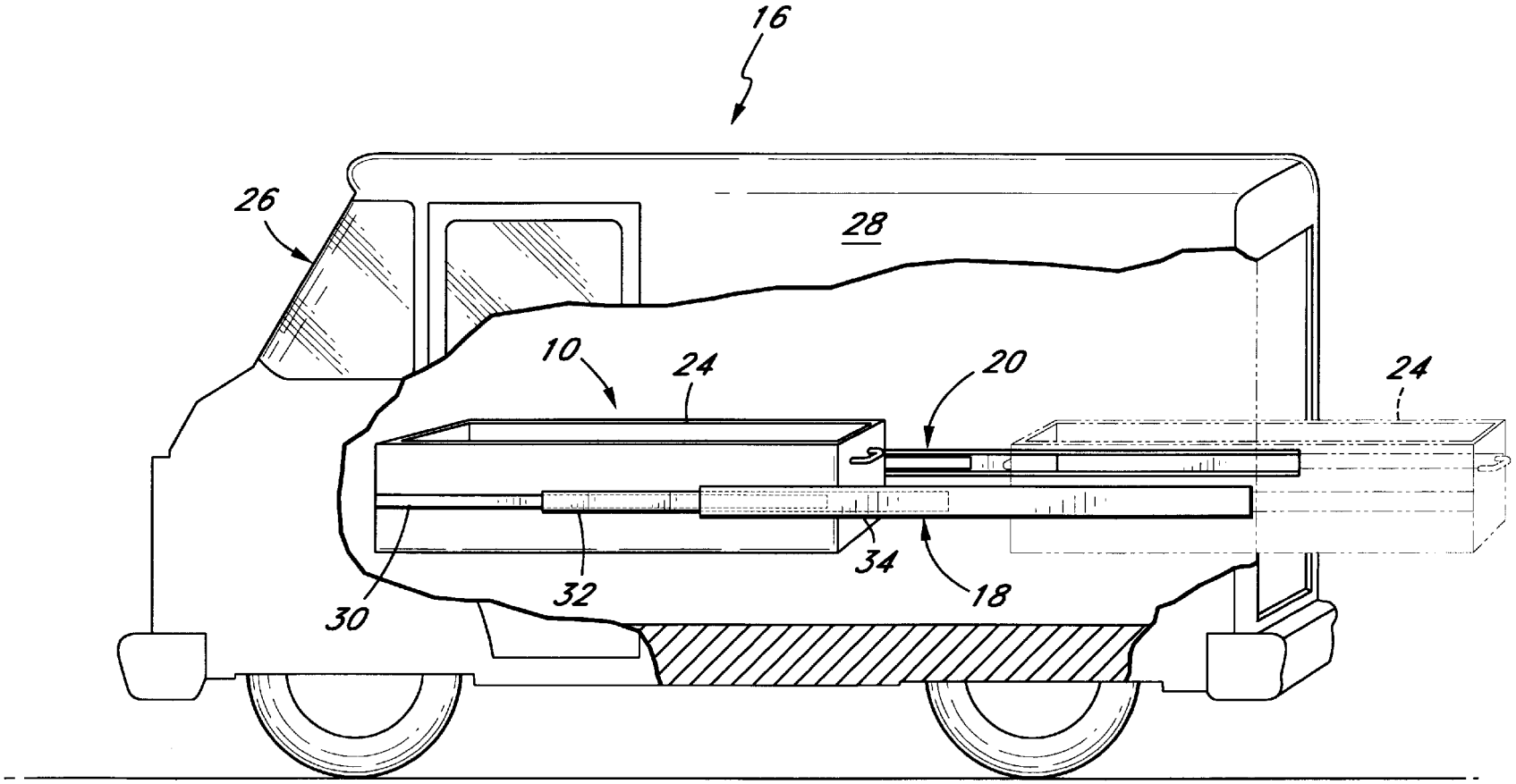
FIG. 1 is a side elevational view of a delivery truck cut away to expose a preferred embodiment of the two-way, double-action slide suspension of the present invention.

FIG. 1 illustrates a slide suspension system 10 of the present invention installed in a delivery van 16. The slide suspension system 10 includes a right side slide suspension 18, a left side slide suspension 20 and a large sliding member or drawer 24 which is shown in solid lines in a left-extended position, and in phantom lines and numbered 24 in a right-extended position. The van 16 comprises a forwarded cab 26 and a rear cargo bay 28. In the right-extended position, the drawer 24 extends out the rear-end of the van 16, and in the left-extended position, the drawer 24 extends into the cab 26 of the van. The slide suspensions 18 and 20 are thus a two-way suspension, and preferably include three channels which are movable relative to one another.

Figure 2:
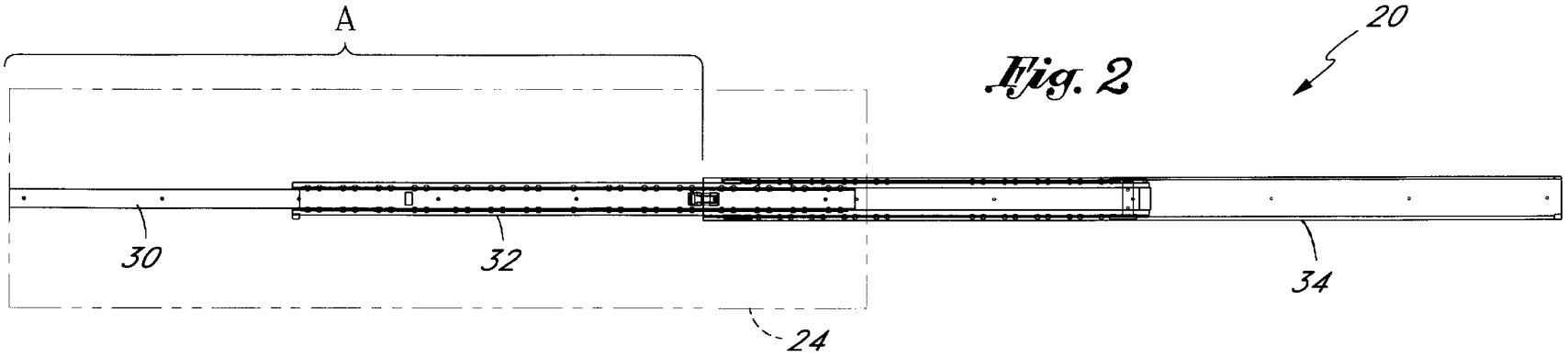
FIG. 2 is an inner elevational view of the preferred embodiment of the slide suspension of the present invention shown in fully extended position to the left.
Figure 5:
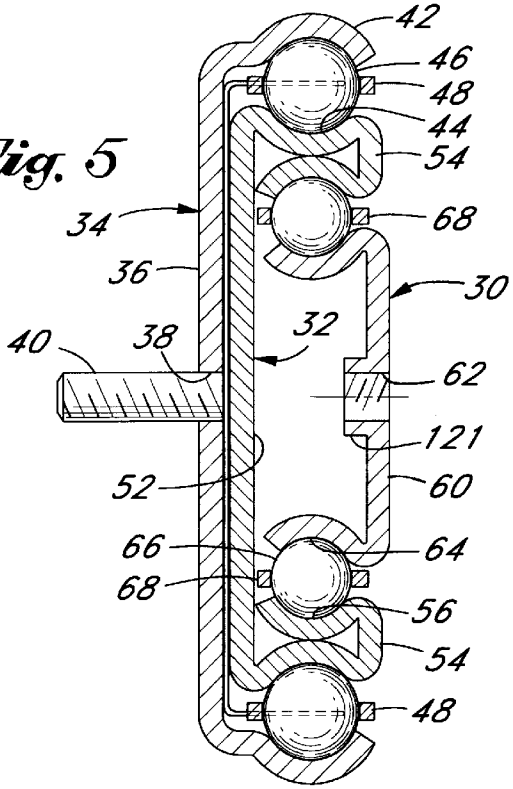
FIG. 5 is a cross-sectional view of the slide suspension taken along line 5—5 of FIG. 4.

In the preferred embodiment, the left side slide suspension 20 and the right side slide suspension 18 are mirror images of one another. Accordingly, only the left side slide suspension 20 will be described in detail and like numbers will be used to designate like elements of the left and right slide suspensions 20 and 18. Referring to FIG. 2, the left slide suspension 20 includes an outer segment or channel 34, a middle segment or channel 32 sized to slide within the outer channel, and an inner segment or channel 30 sized to slide within the middle channel. As illustrated in FIG. 5, the outer and middle channels 34 and 32, respectively, are generally C-shaped in cross-section and open in the same direction, and the inner channel 30 is also generally C-shaped in cross-section but opens in the opposite direction. The inner channel 30 nests within the interior of the "C" of the middle channel 32 which nests within the interior of the "C" of the outer channel 34. The three channels are adapted to slide with respect to one another longitudinally, and their interacting motion will be described in more detail below.

The outer channel 34 mounts rigidly to a frame or to the side panel 28 of the van, and the inner channel 30 mounts rigidly to the opposing side wall of the drawer 24. The middle channel 32 is not rigidly attached to either the drawer 24 or the outer frame, and provides the "suspension" which gives the name to this particular type of drawer slide.

Figure 3:
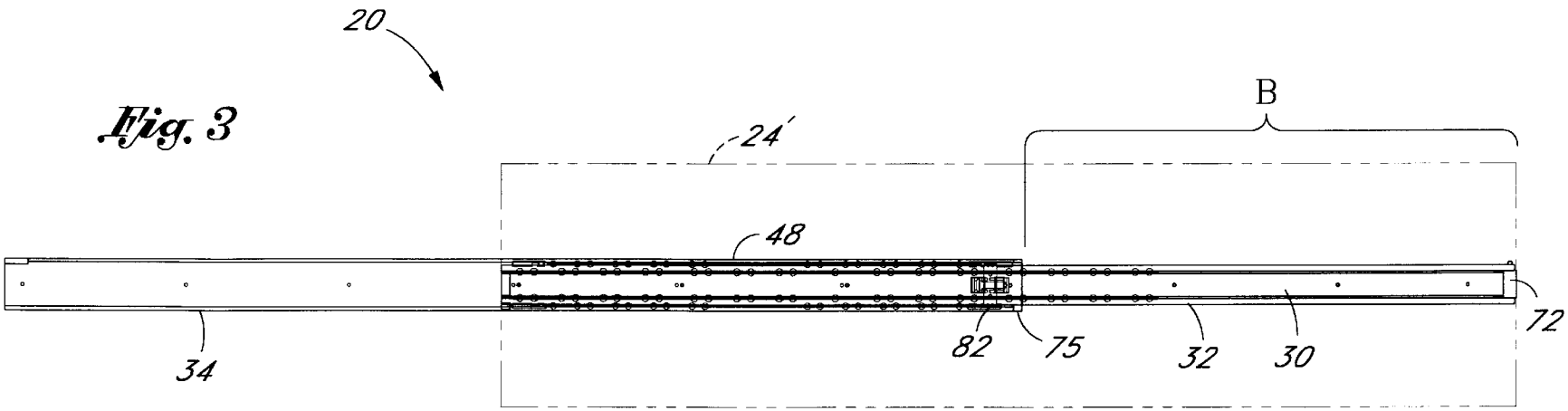
FIG. 3 is an elevational view of the slide suspension of FIG. 2 shown in a fully extended position to the right.
Figure 4:
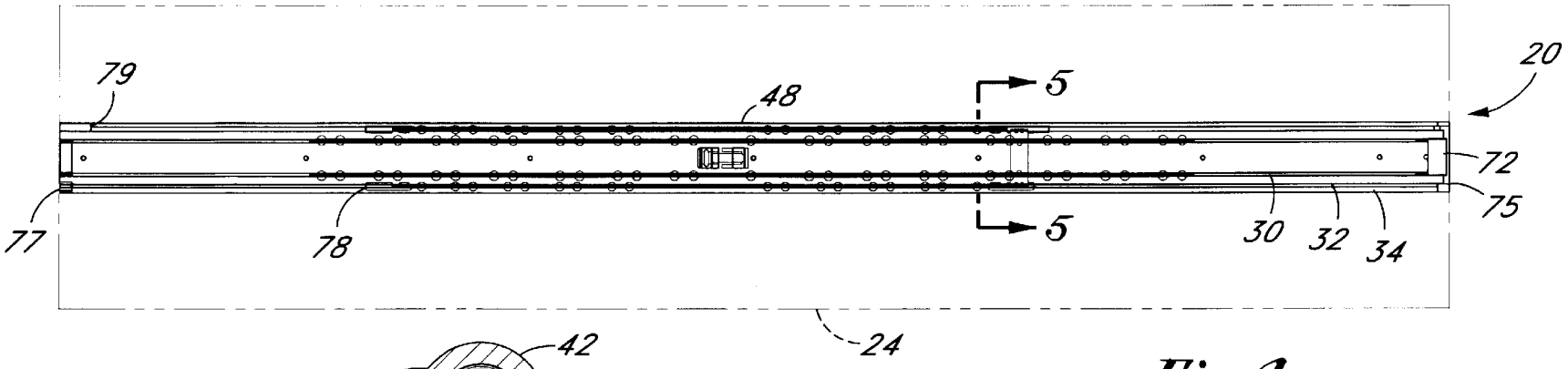
FIG. 4 is an elevational view of the slide suspension of FIG. 2 in a fully retracted position.

FIG. 2 illustrates the slide suspension extended fully to the left (as shown in FIG. 1), and FIG. 3 illustrates the slide suspension extended fully to the right. As seen in FIG. 4, the lengths of the inner channel 30, middle channel 32, and outer channel 34 are approximately equal and thus the ends of the inner channel are positioned at the ends of the drawer. As illustrated in FIG. 2, the drawer 24 can thus be extended a distance A to the left of the leftmost end of the outer channel 34. The distance A is preferably four-fifths of the length of the drawer. In the preferred embodiment, the length of each of the channels is approximately 60 inches, and thus the distance A is approximately 48 inches.

FIG. 3 illustrates the inner channel 30 and middle channel 32 extended to the right of the outer channel 34 a distance B. The distance B is preferably approximately one-half the length of the drawer 24, or approximately 30 inches.

The preferred embodiment of the present slide suspension 20 enables a double-action sequenced extension to the left, to the full extension A, but only a single-action extension to the right to the distance B. This configuration is particularly suitable for vans 22 of the type shown in FIG. 1, wherein the drawer 24 is desirably extendable a substantial distance into the cab 26 of the van, but is extendable a lesser distance out the rear of the van. It will be appreciated, however, upon a reading of this disclosure of the present invention, that the suspension 20 may be adapted to provide a double-action extension both to the left and to the right. Again, the restriction of a single-action extension to the right is preferred for environments such as the delivery van 22.

Now with reference to FIGS. 5 and 6, the internal components of the suspension slide 20 will be described. As mentioned, the channels 30, 32 and 34 are generally C-shaped. The outer channel 34 includes a web 36 within which a plurality of laterally centered, intermittently-spaced threaded apertures 38 are provided. The apertures receive threaded fastening studs 40 which extend into the surrounding fixed frame, or into the side panel of the van cargo bay 28 shown in FIG. 1. The web 36 is flat and abuts flush against a flat surface of the surrounding frame. Of course, other mounting means may be provided, but the threaded stud 40 is particularly preferred as it does not project passed the surface of the web 36 toward the middle channel 32.

The outer channel 34 further includes a pair of arcuate flanges 42 on either side of the web 36 which define outer races for a bearing arrangement between the outer channel 36 and the middle channel 32. More specifically, the outer race 42 is concave-in, and faces a concave-out arcuate wall 44 of the middle channel 32 defining an inner race. A plurality of ball bearings 46 are positioned between the arcuate flange 42 and arcuate wall 44, and are held in longitudinally spaced pairs by an elongated bar-like retainer 48. There are thus two sets of retainers 48 and ball bearings 46 between the outside of the arcuate walls 44 of the middle channel 32 and the arcuate flanges 42 of the outer channel 34. The retainers 48 include a plurality of apertures 50 for receiving the ball bearings 46. The number of ball bearings 46 and their spacing may be varied, and a particularly preferred embodiment is shown.

With reference to FIG. 5, the middle channel 32 includes a flat web 52 which is parallel to and closely spaced from the web 36 of the outer channel 34. The web 52 terminates at rounded corners leading to the concave-out arcuate walls 44. A connector section 54 extending generally parallel to the web 52 joins the arcuate walls 44 with a pair of concave-in arcuate walls 56. The walls 56 provide outer raises for a second bearing arrangement provided between the middle channel 32 and the inner channel 30.

The inner channel 30 comprises a flat web 60 interrupted along the center line at spaced longitudinal intervals by a plurality of threaded apertures 62. The threaded apertures 62 receive fasteners for attaching the inner channel 30 to the drawer 24. The spacing of the apertures 62 shown in FIG. 6 may be varied.

The bearing arrangement between the inner channel 30 and the middle channel 32 comprises the aforementioned concave-in arcuate walls 56 facing concave-out arcuate flanges 64 on the inner channel defining inner raises. A plurality of ball bearings 66 held within bar-like retainers 68 provide the bearing surfaces between the inner channel 30 and the middle channel 32. The retainers 68 include a plurality of apertures 70, as seen in FIG. 6, which are spaced in pairs at regular intervals as shown. The arrangement of the holes may be varied, however, and it will be noted that the retainers 68 between the inner channel 30 and the middle channel 32 are longer than the retainers 48 between the middle channel 32 and the outer channel 34. This configuration provides added support between the inner channel 30 and the middle channel 32, and would generally not be preferred if the inner channel 30 were extendable in both directions. As seen in FIGS. 2 and 3, in the preferred embodiment, the inner channel 30 only extends with respect to the middle channel 32 to the left. An elastomeric stop 72 is mounted by a pin 74 at right end of the middle channel 32 to prevent the inner channel 30 from leftward movement past the right end of the middle channel. This stop can be seen installed in FIGS. 3 and 4 with the inner channel 30 abutting against it. One of skill in the art will appreciate that the lengths of the retainers 48 and 68 may vary depending on the particular configuration of slide, and should not be considered limiting.

The outer channel 34 further includes a stop 75 on its right end which serves to limit the rightward travel of the middle channel 32. A second stop 79 formed on the left end of the outer channel 34 limits the leftward movement of the middle channel 32. Finally, and as will be explained below, a stop 77 attached to the left end of the middle channel 32 acts in conjunction with the right stop 75 to restrict further rightward travel of the middle channel 32 with respect to the outer channel 34. While stop 77 is shown as a separate member, it is contemplated that in production this stop will be formed by deforming the metal of the middle segment in a manner similar to stop 79. As seen in FIG. 6, the middle channel includes a pair of stop members 81 formed on a left end from the web 52. The inner channel 30 further includes a pair of stops 83 extending from the right end.

Figure 6:
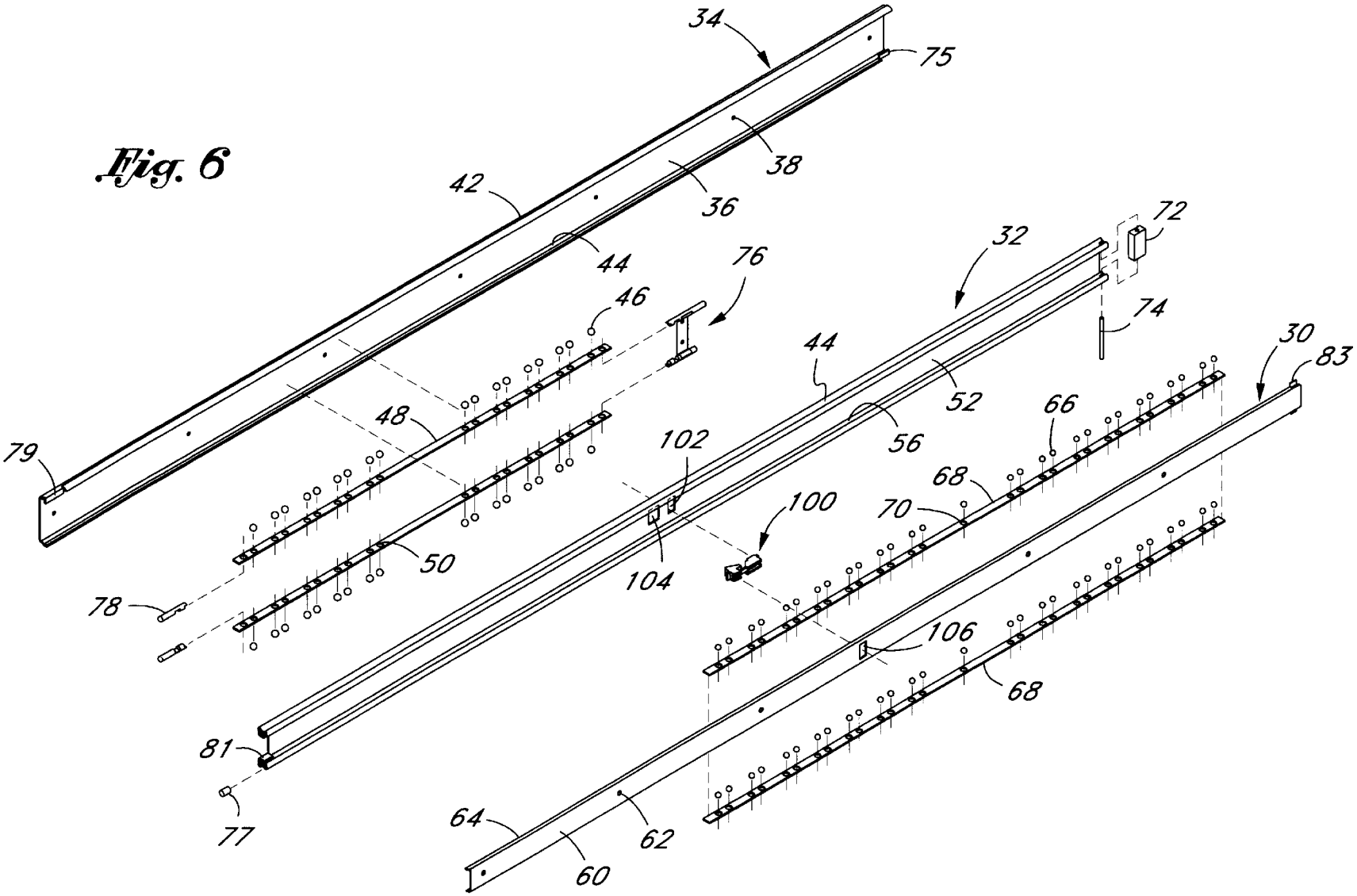
FIG. 6 is an exploded perspective view of the slide suspension of FIG. 2.
Figure 7:
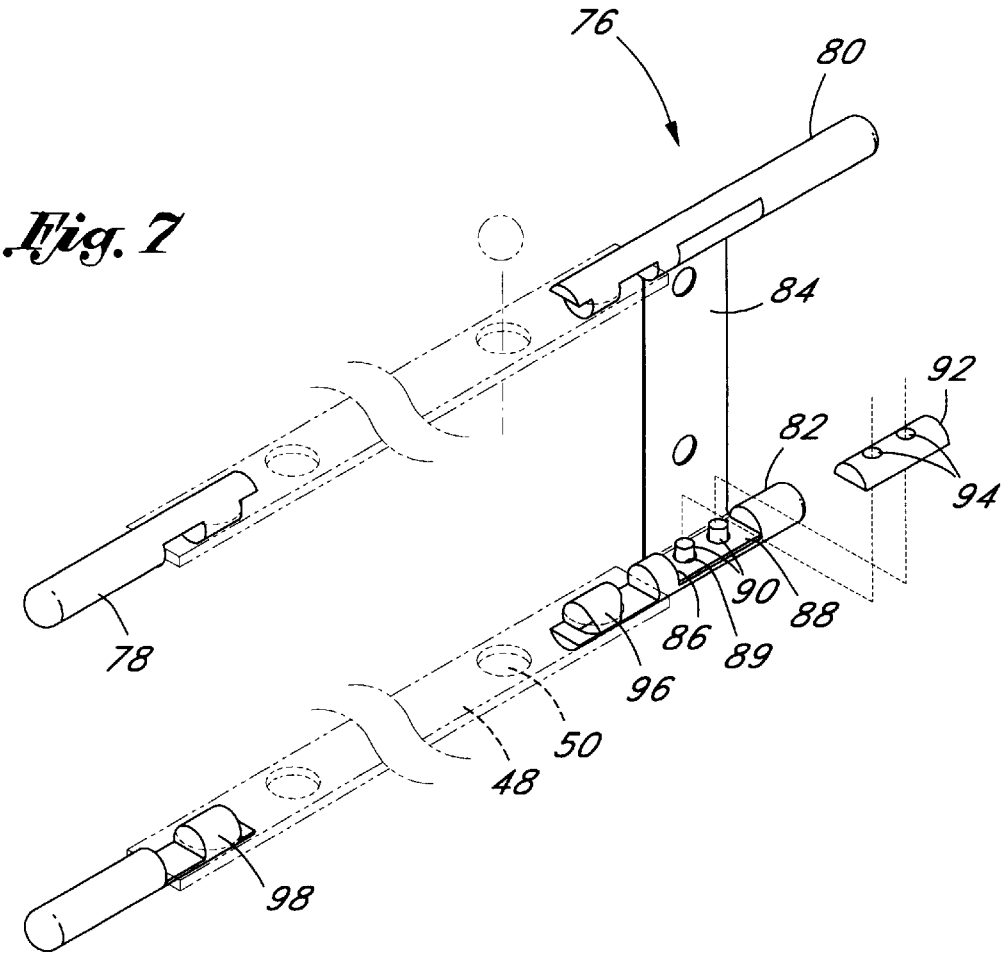
FIG. 7 is a perspective view of a plurality of resilient bumpers attached to ball bearing retainers, shown in phantom, and a bridge member connecting the retainers.

As seen in FIG. 6, the retainers 48 of the bearing arrangement provided between the middle channel 32 and the outer channel 34 are coupled together using a bridge 76. The bridge 76 ensures that both of the retainers 48 and, therefore, both series of bearings 46 move together. At the opposite end of each of the retainers 48 from the bridge 76 is a bumper 78. These components are shown in greater detail in FIG. 7, with the retainers 48 shown in phantom and cut away. The retainer bridge 76 comprises a first bridge bumper 80, second bridge bumper 82, and a bridge member 84 spanning the distance between the bumpers. The bridge member 84 is preferably a thin metal plate, and the bumpers 80 and 82 are preferably plastic rods. The bridge member 84 may be molded within or mechanically fastened to the bumpers 80 and 82. More specifically, as seen in FIG. 7, each of the bumpers 80 and 82 includes a notch 86 for receiving a tab 88 bent 90° from the main body of the bridge member 84. Each of the bent tabs 88 includes a pair of throughholes 89 which receive pins 90 extending upward from the bottom of the notch 86. A separate, generally semi-cylindrical piece 92 then fits within the notch 86 and over the pins 90 to clamp the tabs 88 therewithin. Preferably, the fit between the pins 90 and the holes 94 in the piece 92 is sufficiently tight to provide a rigid assembly. Each of the first and second bridge bumpers 80 and 82 further includes a post 96 which is sized to fit within a terminal aperture 50 of the retainer 48 on that respective side. Likewise, each of the retainer bumpers 78 includes a similar post 98 sized to fit within a terminal aperture 50 of the respective retainer 48 to couple the bumper to the retainer. The spacing between the middle channel 32 and the outer channel 34 is such that the bumpers and retainer cannot be decoupled once installed therebetween. In production, it is contemplated that the separate pieces 92 will be eliminated and that the first bridge bumper 80 and second bridge bumper 82 will be directly molded around the tabs 88 of the bridge 84.

FIG. 6 also shows an interlock 100 which is generally positioned between the inner channel 30 and the middle channel 32. The interlock 100 is retained in the space between the two channels in a mounting recess 102 formed in the middle channel 32. As will be explained below, one end of the interlock 100 is movable through a recess 104 in the middle channel 32, and a recess 106 in the inner channel 30. Depending on the position of the interlock 100 in either the recess 104 or the recess 106, the inner channel 30 will alternately be restrained or free to move with respect to the middle channel 32.

Figure 8:
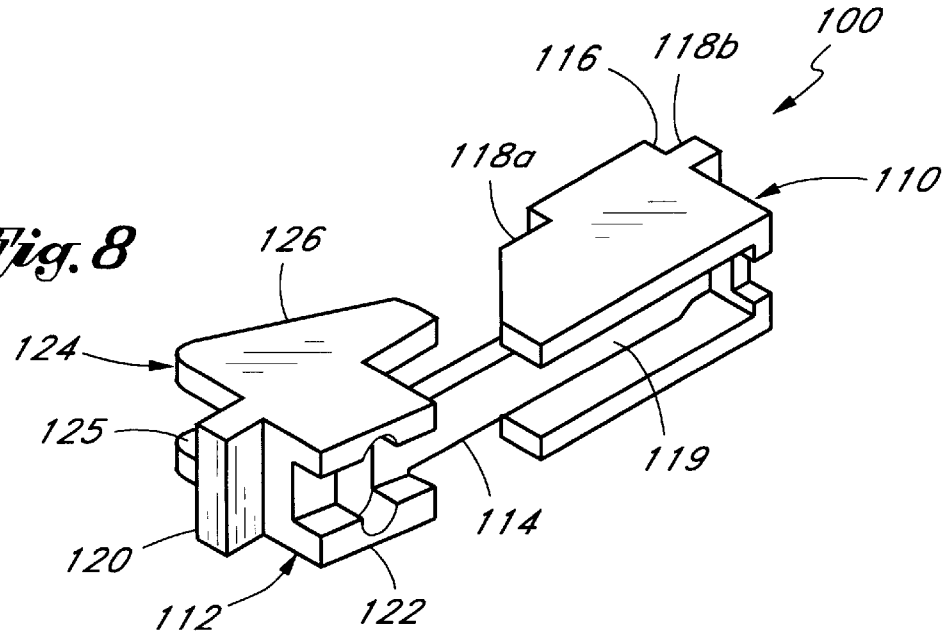
FIG. 8 is a perspective view of a preferred interlock of the present invention.

The interlock 100 is shown in detail perspective in FIG. 8 and generally comprises a fixed block 110, a movable or actuating block 112, and a connecting spring 114. It will be appreciated by those of skill in the art that the interlock 100 may be made in a variety of shapes and configurations. However, the illustrated configuration is preferred the cooperation of the interlock 100 with the recesses 102, 104 and 106 provides an inexpensive, easy to assemble, narrow and reliable sequencing arrangement. The fixed block 110 is fixed with respect to the middle channel, the actuating block 112 either fixes or releases the inner channel 30 with respect to the middle channel 32, and the spring 114 connects the fixed block with the actuating block.

Figure 10B:
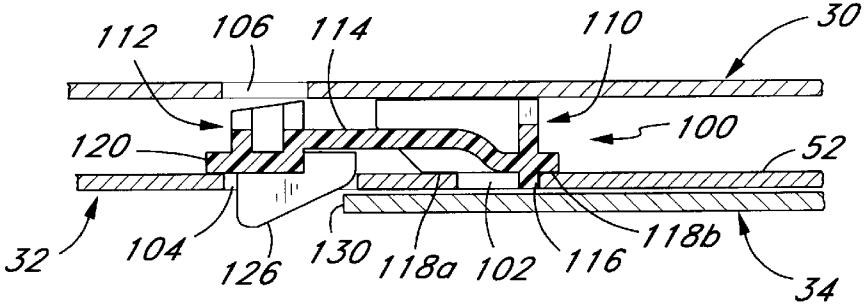
FIG. 10B is an enlarged cross-sectional view of the interlock region taken along 10B—10B of FIG. 10A with the interlock in a position permitting the inner and middle channel to move independently.

With reference to FIGS. 8 and 10B, the fixed block 110 includes a generally rectangular projection 116 extending from a pair of reference shoulders 118*a,* 118*b.* As seen in FIG. 10B, the projection 116 fits snugly within and about the edge forming the mounting recess 102. Similarly, the shoulders 118*a,* 118*b* abut an inner surface of the web 52 of the middle channel 32. The fixed block 110 has a height sufficient to extend into close proximity to the web 60 of the inner channel 30. As seen in FIG. 8, the side of the interlock 100 facing the web 60 has a central longitudinal depression 119 which allows passage of short tubular collars 121 extending from the web 60 of the inner channel 30, as seen in FIG. 5. These tubular collars 121 provide support for fasteners extending through the sidewall of the drawer 24 into the threaded apertures 62.

The movable block 112 includes a reference flange 120 extending from an end opposite the fixed block 110, a channel lock 122, and a cam member 124 having a cam surface 126 is angled with respect to the spring 114. The movable block 112 is cantilevered on the end of the spring 114 with respect to the fixed block 110.

The interlock 100 is shown in a relaxed configuration in FIG. 8 (and FIG. 10B), with the spring 114 extending in a direction at a small angle with respect to the inner and outer surfaces of the fixed block 110 and the reference flange 120. The inner surface of the channel lock 122 is angled with respect to the spring 114 such that an edge toward the fixed block 110 extends away from the plane of the spring 114 farther than an edge away from the fixed block. The cam member lock 124 includes an outermost end closest to the reference flange 120, and the cam surface 126 which tapers inward toward the spring 114. The cam member lock 124 is bifurcated with a channel 125 provided therein.

In a preferred embodiment of the present invention, the channels 30, 32, and 34 are manufactured of high strength, low alloy, cold-rolled commercial quality matte finish steel in accordance with ASTM A568. The channels are made of steel having thickness of between 0.0897" and 0.097". The bumpers 78, 80, and 82, and interlock 100, are preferably made of an acetyl such as DELRIN having an NC 100 rating, or similar durable synthetic material. The retainers 48 and 68 are preferably made of preplated zinc having a thickness of approximately 0.104". The gap formed between the web 52 of the middle channel 32 and the web 36 of the outer channel 34 is preferably between 0.024" and 0.035", and the bridge member 84 has a thickness which is slightly undersized with respect to this gap.

OPERATION

Before the interaction of the interlock 100 with the channels is described, the general travel of the channels with respect to each other will be described with reference to FIGS. 2–4. FIG. 4 shows the slide suspension 20 with the intermediate channel 32 and inner channel 30 fully retracted within the outer channel 34. If the drawer is pulled to the right, the fasteners connecting the drawer 24 and the inner channel 30 will apply force to the inner channel to move it to the right which movement is restricted by the stop 72. This causes the middle channel 32 to slide to the right with respect to the outer channel 34 to the extent that the retainers 48, bridge 76 and bumpers 78 allow. More specifically, as seen in FIG. 3, the movement of the middle channel 32 causes the bearing retainers 48 to move from a position shown in FIG. 4 to the right. Due to the geometry of the channels and ball bearings, displacement of the middle channel 32 a given distance displaces the retainers one-half that distance. Eventually, and simultaneously, the bumper 82 contacts the stop 75 on the right end of the outer channel 34, and the stop 77 contacts the bumper 78 on the left end of one of the retainers 48. Thus, the bumper 78, retainer 48, and bumper 82 prevent further movement of the middle channel 32 to the right.

Referring now to FIGS. 2, 4, 9 and 1OA–B, the movement of the drawer 24 to the left causes the inner channel 30 and middle channel 32 which are locked together by the interlock 100 to move together to the left. The drawer continues moving to the left until the position shown in FIG. 9. In this position, the bumper 78 contacts the stop 79 which halts any further leftward movement of the middle channel 32. When the middle channel 32 is in this fully extended position, the interlock 100 releases the inner channel 30 permitting it to move to the left. Thus, the full extent of travel of the inner channel 30 with respect to the middle channel 32 is seen in FIG. 2. The stops 83 on the inner channel 30 contact the retainers 68 on the right end thereof at the same time that the left end of the retainers contact the stops 81. This is the position shown in FIG. 2. Thus, it will be seen that rigid stops are provided to limit the travel of the channels with respect to one another.

Figure 9:
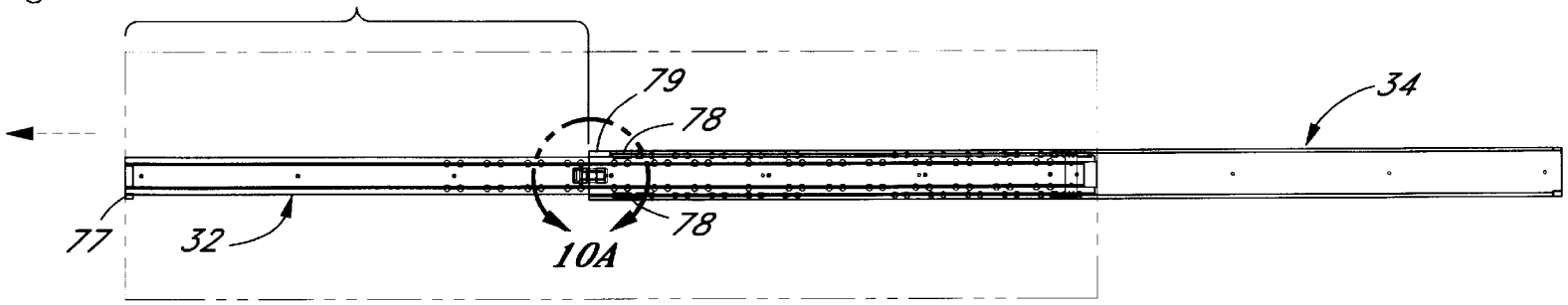
FIG. 9 is an elevational view of the slide suspension showing a middle channel just prior to its farthest leftward position.
Figure 11A:
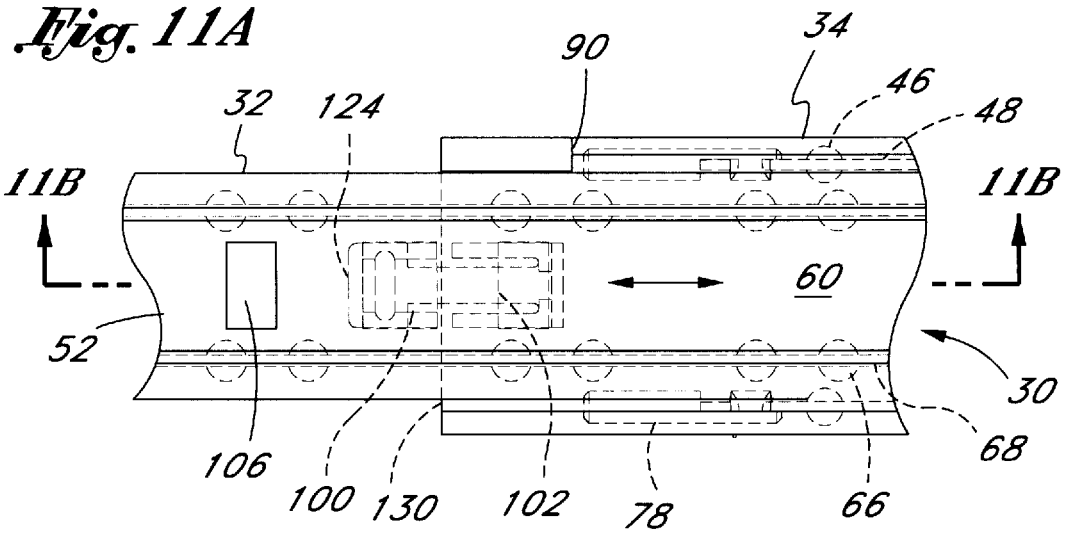
FIG. 11A is an enlarged elevational view of the interlock region of the slide assembly in a position where the inner channel has moved independently to the left with respect to the middle channel.
Figure 11B:
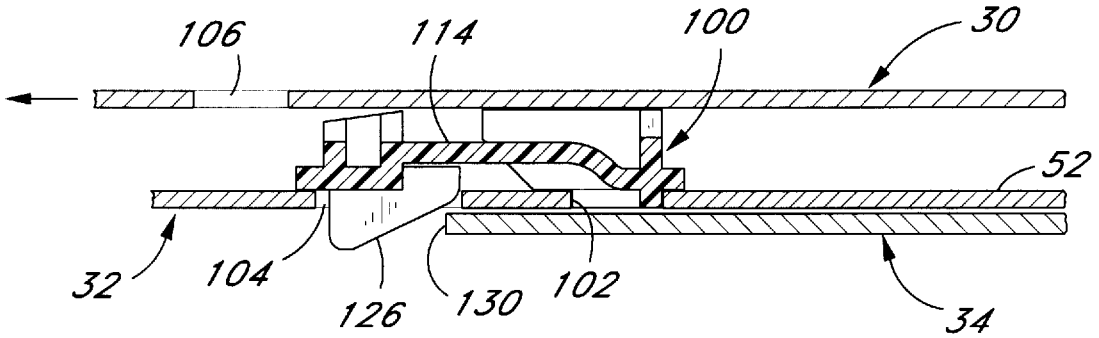
FIG. 11B is an enlarged cross-sectional view of the interlock region taken along 11B—11B of FIG. 11A.
Figure 12:
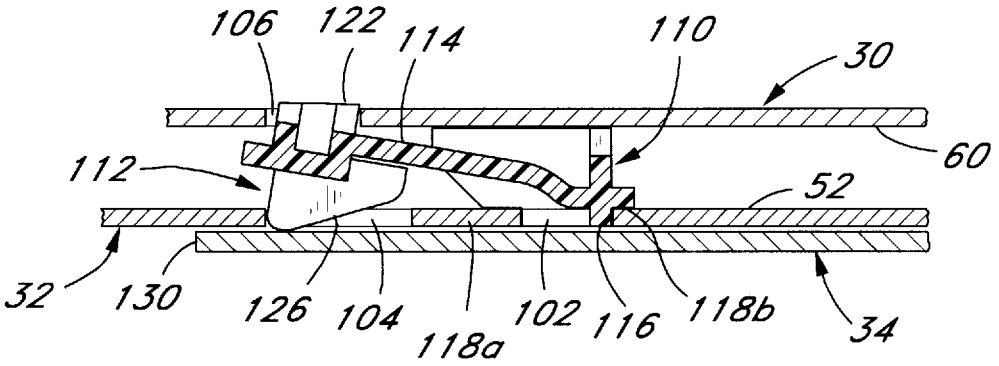
FIG. 12 is an enlarged cross-sectional view of the interlock region of the slide assembly when the inner segment and the middle segment are a short distance to the right of the position shown in FIG. 9.

The interaction of the interlock 100 with the channels will be described with reference to FIGS. 9–13. As mentioned, FIG. 9 shows the position of the slide suspension 20 in which the middle channel 32 has reached its full travel limit to the left. The detail of the interlock region shortly before this position is shown in FIG. 12. In this position, the channel lock 122 extends through the aperture 106. Prior to any further leftward movement of the inner channel 30, the inner channel and the middle channel 32 are thus locked together.

Figure 10A:
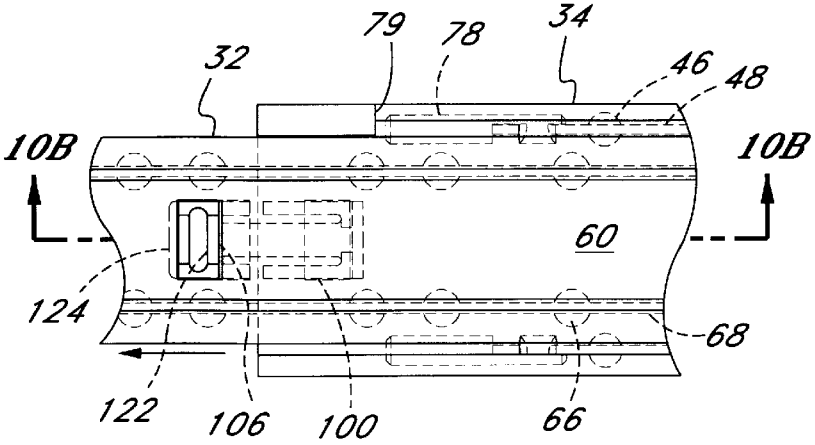
FIG. 10A is an enlarged elevational view of the interlock region shown in the circle 10A of FIG. 9.
Figure 13:
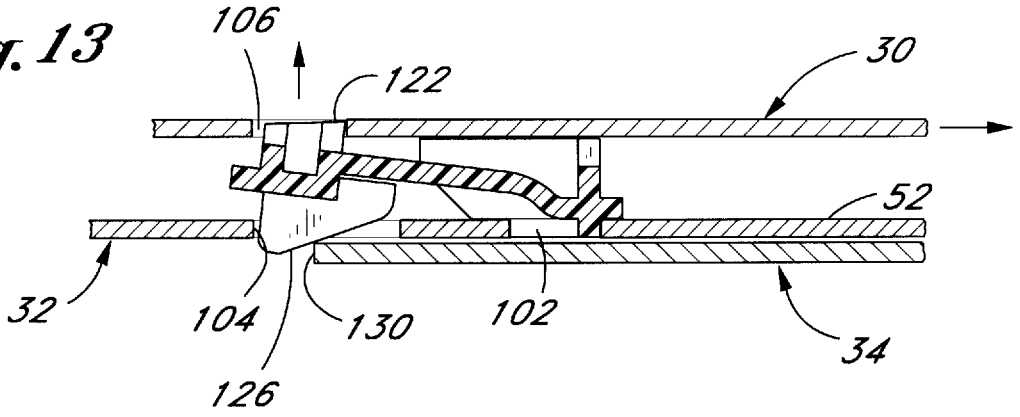
FIG. 13 is an enlarged cross-sectional view of the interlock region of the slide assembly when the inner segment and the middle segment are between the position shown in FIG. 9 and the position shown in FIG. 12, illustrating the interaction of the camming surface with the end of the outer segment.

As shown in FIGS. 10A–10B, further movement of the inner channel 30 and the middle channel 32 together prior to the middle channel stopping allows the cam member 124 to extend past a left terminal end 130 of the outer channel 34. As the assembly moves between the position illustrated in FIGS. 12 and 10A–B, the canning surface 126 cooperates with the terminal end of the outer channel. FIG. 13, shows the opposite movement of the inner channel 30, and will be described below, but illustrates the moment at which the interlock 100 is moving from a position in which the inner and middle channels are locked together, to a position in which the inner channel is free to move with respect to the middle channel. More particularly, the spring 114 biases the actuating block 112 downward into contact with the web 36, as seen in the figures. When the actuating block 112 has passed the left end 130 of the outer channel 34, the spring 114 causes the cam member 124 to extend downward beyond the web 52 of the middle channel 32 and beyond the outer side of the outer channel 34. Advantageously, only a small amount of space is needed to permit this extension of the middle/outer lock 124. The interlock 100 is then in a relaxed state, as seen in FIGS. 10A–10B. The downward movement of the actuating block 112 releases the channel lock 122 from the recess 106 and allows the inner channel 30 to move further to the left as seen in FIGS. 11A—11B. The inner channel 30 can then move to its full extension as seen in FIG. 2. Thus, the slide suspension 20 has an automatic sequenced extension to the left with the middle channel 32 moving first until its full travel has been reached, after which the inner channel 30 may move. This greatly enhances the strength of the slide suspension 20 as the inner channel is not allowed to move and carry the entire weight of the drawer 24 with its heavy contents therein prior to the middle channel moving.

During retraction of the drawer 24, the inner channel 30 moves to the right until the aperture 106 is aligned with the channel lock 122. At this point, the interlock 100 is still in the relaxed position shown in FIG. 10B. At the instant that the recess 106 is positioned above the channel lock 122, the inner channel 30 reaches its full range of travel to the right with respect to the middle channel 32, and contacts the stop 72. This causes the middle channel 32 to begin moving to the right. As seen in FIG. 13, movement of the inner channel 30 and the middle channel 32 together to the right causes the cam surface 126 to contact the left end 130 of the outer channel 34. This forces the actuating block 112 upward so that the channel lock 122 again projects within the recess 106, eventually reaching its maximum projection as shown in FIG. 12. Of course, further movement of the inner channel 30 and middle channel 32 together to the right continues until the middle channel 32 reaches its full length of travel as seen in FIG. 3. Significantly, throughout this movement to the right the channel lock 122 of the actuating block remains within the recess 106 and canning surface avoids contacting the bridge 84. This prevents the bridge 84 from causing binding of the suspension.

Although this invention has been described in terms of certain preferred embodiments, other embodiments that will be apparent to those of ordinary skill in the art are intended to be within the scope of this invention. Accordingly, the scope of the invention is intended to be defined by the claims.

What is claimed is:

1. An assembly comprising:

an outer segment fixable to a surrounding frame;

a middle segment slidable with respect to the outer segment;

an inner segment slidable with respect to the middle segment;

an interlock positioned generally between the middle segment and the inner segment, the interlock including at least a first portion movable toward and away from said inner segment, said first portion being movable between a first position in which the inner segment and the middle segment are locked to move together in a first direction and second direction, and a second position in which the inner segment is free to move with respect to the middle segment in said first direction and said second direction, wherein said interlock further comprises a second portion fixed with respect to one of said inner segment and said middle segment, wherein said interlock comprises a single piece, wherein said first portion is cantilevered with respect to said second portion and said interlock is resilient, wherein said first portion defines a camming surface which cooperates with one of said outer segment and said inner segment to move said interlock between one of said first position and said second position and said second position and said first position, wherein said inner segment defines a first edge which defines a first aperture within which said first portion is located when said interlock is in said first position.

2. An assembly, comprising:

an outer segment fixable to a surrounding frame;

a middle segment slidable with respect to the outer segment;

an inner segment slidable with respect to the middle segment;

an interlock positioned generally between the middle segment and the inner segment, the interlock including at least a first portion movable toward and away from said inner segment, said first portion being movable between a first position in which the inner segment and the middle segment are locked to move together, and a second position in which the inner segment is free to move with respect to the middle segment, wherein said interlock further comprises a second portion fixed with respect to one of said inner segment and said middle segment, said interlock comprises a single piece, said first portion is cantilevered with respect to said second portion and said interlock is resilient, said first portion defines a camming surface which cooperates with one of said outer segment and said inner segment to move said interlock between one of said first position and said second position and said second position and said first position, said inner segment defines a first edge which defines a first aperture within which said first portion is located when said interlock is in said first position and wherein said middle segment defines a second edge which defines a second aperture within which said camming surface of said first portion extends when said interlock is in said second position.

3. An assembly, comprising:

an outer segment fixable to a surrounding frame;

a middle segment slidable with respect to the outer segment;

an inner segment slidable with respect to the middle segment;

an interlock positioned generally between the middle segment and the inner segment, the interlock including at least a first portion movable toward and away from said inner segment, said first portion being movable between a first position in which the inner segment and the middle segment are locked to move together in a first direction and second direction, and a second position in which the inner segment is free to move with respect to the middle segment in said first direction and said second direction, wherein said interlock further comprises a second portion fixed with respect to one of said inner segment and said middle segment, wherein said interlock comprises a single piece, wherein said first portion is cantilevered with respect to said second portion and said interlock is resilient, wherein said first portion defines a camming surface which cooperates with one of said outer segment and said inner segment to move said interlock between one of said first position and said second position and said second position and said first position, wherein said inner segment defines a second edge which defines a second aperture within which said second portion is located when said interlock is in said first position and said second position.

4. The assembly of claim 3, further comprising:

a first ball retainer defining a first series of stations for bearings, said first ball retainer positioned to a first side of said middle segment between said outer segment and said middle segment;

a second ball retainer defining a second series of stations for bearings, said second ball retainer positioned to a second side of said middle segment between said outer segment and said middle segment;

a first set of bearings within said first series of stations;

a second set of bearings within said second series of stations; and a bridge connecting said first retainer and said second retainer, at least the first portion of said interlock and said bridge avoiding contact with one another throughout the range of motion of said assembly.

5. An assembly, comprising:

an outer segment fixable to a surrounding frame;

a middle segment slidable with respect to the outer segment;

an inner segment slidable with respect to the middle segment;

an interlock positioned generally between the middle segment and the inner segment, the interlock including at least a first portion movable toward and away from said inner segment, said first portion being movable between a first position in which the inner segment and the middle segment are locked to move together in a first direction and second direction, and a second position in which the inner segment is free to move with respect to the middle segment in said first direction and said second direction wherein said inner segment defines a first edge which defines an aperture within which said first portion is located when said interlock is in said first position.

6. An assembly, comprising:

an outer segment fixable to a surrounding frame;

a middle segment slidable with respect to the outer segment;

an inner segment slidable with respect to the middle segment;

an interlock positioned generally between the middle segment and the inner segment, the interlock including at least a first portion movable toward and away from said inner segment, said first portion being movable between a first position in which the inner segment and the middle segment are locked to move together, and a second position in which the inner segment is free to move with respect to the middle segment, wherein said inner segment defines a first edge which defines an aperture within which said first portion is located when said interlock is in said first position and wherein said middle segment defines a second edge which defines an aperture through which said first portion extends when said interlock is in said second position.

7. The assembly of claim 6, further comprising:

a first ball retainer defining a first series of stations for bearings, said first ball retainer positioned to a first side of said middle segment between said outer segment and said middle segment;

a second ball retainer defining a second series of stations for bearings, said second ball retainer positioned to a second side of said middle segment between said outer segment and said middle segment;

a first set of bearings within said first series of stations;

a second set of bearings within said second series of stations; and a bridge connecting said first retainer and said second retainer, at least the first portion of said interlock and said bridge avoiding contact with one another throughout the range of motion of said assembly.

8. An assembly, comprising:

an outer segment fixable to a surrounding frame, said outer segment having a first end and a second end;

a middle segment slidable with respect to the outer segment;

an inner segment slidable with respect to the middle segment;

an interlock, said inner segment and said middle segment movable in a first direction beyond said first end of said outer segment and in a second direction beyond said second end of said outer segment, said interlock preventing relative movement between said inner segment and said middle segment when said middle segment is less than fully extended in said first direction beyond said first end of said outer segment and interlock preventing relative movement between said inner segment and said middle segment when said middle segment is less than fully extended in said second direction beyond said second end of said outer segment, wherein said actuating portion is moved between one of said first position and said second position and said second position and said first position through the direct interaction of force between said interlock and one of said inner segment said middle segment and said outer segment.

9. The assembly of claim 8, wherein said interlock permits relative movement between said inner segment and said middle segment when said middle segment is fully extended in said first direction beyond said first end of said outer segment.

10. The assembly of claim 9, further comprising a stop which prevents relative movement between said inner segment and said middle segment when said middle segment is fully extended in said second direction beyond said second end of said outer segment.

11. The assembly of claim 10, further comprising:

a first ball retainer defining a first series of stations for bearings, said first ball retainer positioned to a first side of said middle segment between said outer segment and said middle segment;

a second ball retainer defining a second series of stations for bearings, said second ball retainer positioned to a second side of said middle segment between said outer segment and said middle segment;

a first set of bearings within said first series of stations;

a second set of bearings within said second series of stations; and a bridge connecting said first retainer and said second retainer, said interlock and at least a portion of said bridge avoiding contact with one another throughout the range of motion of said assembly.

12. The assembly of claim 8, further comprising:

a first ball retainer defining a first series of stations for bearings, said first ball retainer positioned to a first side of said middle segment between said outer segment and said middle segment;

a second ball retainer defining a second series of stations for bearings, said second ball retainer positioned to a second side of said middle segment between said outer segment and said middle segment;

a first set of bearings within said first series of stations;

a second set of bearings within said second series of stations; and a bridge connecting said first retainer and said second retainer, said interlock and said bridge avoiding contact with one another throughout the range of motion of said assembly.

13. The slide assembly of claim 8, wherein said actuating portion is moved between the other of said first position and said second position and said second position and said first position through the direct interaction of force between said interlock and one of said inner segment, said middle segment and said outer segment.

14. The slide assembly of claim 13, wherein said actuating portion is movable toward or away from the inner segment.

15. A slide assembly, comprising:

an outer segment fixable to a surrounding frame;

a middle segment slidable with respect to the outer segment;

an inner segment slidable with respect to the middle segment;

an interlock comprising a single piece positioned generally between the middle segment and the inner segment, the interlock including an actuating portion and a fixed portion, said actuating portion being movable between a first position in which the inner segment and the middle segment are locked to move together, and a second position in which the inner segment is free to move with respect to the middle segment, wherein one of said inner segment and said middle segment define a first edge defining a first aperture, and wherein said fixed portion of said interlock is fixed to said one of said inner segment and said middle segment solely through the positioning of said interlock generally between said inner segment and said middle segment and through abutment against said first edge.

16. The slide assembly of claim 15, wherein said actuating portion is moved between one of said first position and said second position and said second position and said first position through the direct interaction of force between said interlock and one of said inner segment, said middle segment and said outer segment.

17. The slide assembly of claim 16, wherein said actuating portion is moved between the other of said first position and said second position and said second position and said first position through the direct interaction of force between said interlock and one of said inner segment, said middle segment and said outer segment.

18. The slide assembly of claim 17, wherein said actuating portion is movable toward or away from the inner segment.

19. The assembly of claim 17, wherein said interlock defines a camming surface which cooperates with one of said outer segment and said inner segment to move said interlock between said first position and said second position.

20. The assembly of claim 19, wherein said actuating portion of said interlock is resiliently connected to said fixed portion and moves between said first position and said second position upon the removal of external force applied to said actuating portion by one of said inner segment, said middle segment and said outer segment.

21. The assembly of claim 20, wherein said inner segment defines a first edge which defines an aperture within which said actuating portion is located when said interlock is in said first position.

22. The assembly of claim 21, wherein said middle segment defines a second edge which defines an aperture within which said camming surface of said actuating portion extends when said interlock is in said second position.

23. The assembly of claim 22, further comprising:

a first ball retainer defining a first series of stations for bearings, said first ball retainer positioned to a first side of said middle segment between said outer segment and said middle segment;

a second ball retainer defining a second series of stations for bearings, said second ball retainer positioned to a second side of said middle segment between said outer segment and said middle segment;

a first set of bearings within said first series of stations;

a second set of bearings within said second series of stations; and a bridge connecting said first retainer and said second retainer, said interlock and said bridge avoiding contact with one another throughout the range of motion of said assembly.

24. A slide assembly, comprising:

an outer segment fixable to a surrounding frame;

a middle segment slidable with respect to the outer segment;

an inner segment slidable with respect to the middle segment;

an interlock comprising a single piece positioned generally between the middle segment and the inner segment, the interlock including an actuating portion and a fixed portion, said actuating portion being movable between a first position in which the inner segment and the middle segment are locked to move together, and a second position in which the inner segment is free to move with respect to the middle segment, wherein said actuating portion is moved between one of said first position and said second position and said second position and said first position through the direct interaction of force between said interlock and one of said inner segment, said middle segment and said outer segment.

25. The slide assembly of claim 21, wherein said actuating portion is moved between the other of said first position and said second position and said second position and said first position through the direct interaction of force between said interlock and one of said inner segment, said middle segment and said outer segment.

26. The slide assembly of claim 25, wherein said actuating portion is movable toward or away from the inner segment.

27. The assembly of claim 25, wherein said interlock defines a camming surface which cooperates with one of said outer segment and said inner segment to move said interlock between said first position and said second position.

28. The assembly of claim 27, wherein said actuating portion of said interlock is resiliently connected to said fixed portion and moves between said first position and said second position upon the removal of external force applied to said biasing member by one of said inner segment, said middle segment and said outer segment.

29. The assembly of claim 28, wherein said inner segment defines a first edge which defines an aperture within which said actuating portion is located when said interlock is in said first position.

30. The assembly of claim 29, wherein said middle segment defines a second edge which defines an aperture within which said camming surface of said actuating portion extends when said interlock is in said second position.

31. The assembly of claim 30, further comprising:

a first ball retainer defining a first series of stations for bearings, said first ball retainer positioned to a first side of said middle segment between said outer segment and said middle segment;

a second ball retainer defining a second series of stations for bearings, said second ball retainer positioned to a second side of said middle segment between said outer segment and said middle segment;

a first set of bearings within said first series of stations;

a second set of bearings within said second series of stations; and a bridge connecting said first retainer and said second retainer, said interlock and said bridge avoiding contact with one another throughout the range of motion of said assembly.

32. An assembly, comprising:

a first slide assembly, comprising:

a first outer segment fixable to a surrounding frame;

a first middle segment slidable with respect to the outer segment;

a first inner segment slidable with respect to the middle segment;

a first interlock positioned generally between the first middle segment and the first inner segment, the first interlock including at least a first portion movable toward and away from said first inner segment, said first portion of said first interlock being movable between a first position in which the first inner segment and the first middle segment are locked to move together, and a second position in which the first inner segment is free to move with respect to the first middle segment, wherein said first portion is moved between one of said first position and said second position and said second position and said first position through the direct interaction of force between said interlock and one of said inner segment, said middle segment and said outer segment;

a second slide assembly, comprising:

a second outer segment fixable to a surrounding frame;

a second middle segment slidable with respect to the outer segment;

a second inner segment slidable with respect to the middle segment;

a second interlock positioned generally between the second middle segment and the second inner segment, the second interlock including at least a first portion movable toward and away from said second inner segment, said first portion of said second interlock being movable between a first position in which the second inner segment and the second middle segment are locked to move together, and a second position in which the second inner segment is free to move with respect to the second middle segment, wherein said first portion is moved between one of said first position and said second position and said second position and said first position through the direct interaction of force between said interlock and one of said inner segment, said middle segment and said outer segment; and a slidable member having a first side and a second side, said first inner segment secured to said first side of said slidable member and said second inner segment secured to said second side of said slidable member.

33. The assembly of claim 32, wherein said first and said second interlock further comprises a second portion fixed with respect to one of said inner segment and said middle segment.

34. A method of sequencing the opening of an assembly having a first outer segment, a middle segment slidable with respect to said first outer segment, and an inner segment slidable with respect to said middle segment, comprising:

positioning an interlock generally between said middle segment and said inner segment;

moving, through the direct interaction of force between said interlock and one of said inner segment, said middle segment and said outer segment, at least a first portion of said interlock one of toward and away from said inner segment to a first position to lock said inner segment with respect to said middle segment; and moving, through the direct interaction of force between said interlock and one of said inner segment, said middle segment and said outer segment, at least said first portion of said interlock one of toward and away from said inner segment to a second position to permit relative movement between said inner segment and said middle segment.

35. The method of claim 34, further comprising fixing a second portion of said interlock with respect to one of said inner segment and said middle segment.

36. The method of claim 35, further comprising moving said first portion of said interlock into a first aperture in said inner segment when said interlock is in one of said first position and said second position.

37. The method of claim 36, further comprising moving said first portion of said interlock into a second aperture in said middle segment when said interlock is in the other of said one of said first position and said second position.

38. An assembly, comprising:

an outer segment fixable to a surrounding frame;

a middle segment slidable with respect to the outer segment;

an inner segment slidable with respect to the middle segment;

an interlock positioned generally between the middle segment and the inner segment, the interlock including at least a first portion movable toward and away from said inner segment, said first portion being movable between a first position in which the inner segment and the middle segment are locked to move together, and a second position in which the inner segment is free to move with respect to the middle segment, wherein said first portion defines a camming surface which cooperates with one of said outer segment and said inner segment to move said interlock between one of said first position and said second position and said second position and said first position, wherein said inner segment defines a first edge which defines a first aperture within which said first portion is located when said interlock is in said first position and wherein said middle segment defines a second edge which defines a second aperture within which said camming surface of said first portion extends when said interlock is in said second position.

* * * * *